United States Patent [19]

Tanigawa et al.

[11] Patent Number: 4,614,174

[45] Date of Patent: Sep. 30, 1986

[54] FUEL CONTROL MEANS FOR ENGINE INTAKE SYSTEMS

[75] Inventors: Yoshitaka Tanigawa, Higashihiroshima; Yoshinori Okino, Hiroshima, both of Japan

[73] Assignee: Mazda Motor Corporation, Hiroshima, Japan

[21] Appl. No.: 686,921

[22] Filed: Dec. 27, 1984

[30] Foreign Application Priority Data

Dec. 29, 1983 [JP] Japan ..... 58-245895

[51] Int. Cl.[4] ..... F02B 3/00

[52] U.S. Cl. ..... 123/478; 123/486; 123/432

[58] Field of Search ..... 123/486, 472, 478, 432

[56] References Cited

U.S. PATENT DOCUMENTS

| | | | |
|---|---|---|---|
| 4,140,088 | 2/1979 | Vulpillieres | 123/478 |
| 4,309,971 | 1/1982 | Chiesa | 123/478 |
| 4,359,991 | 11/1982 | Stumpp | 123/478 |
| 4,413,601 | 11/1983 | Matsuoka | 123/486 |
| 4,418,674 | 12/1983 | Hasegawa | 123/491 |
| 4,445,483 | 5/1984 | Hasegawa | 123/492 |
| 4,471,742 | 9/1984 | Kishi | 123/478 |
| 4,492,203 | 1/1985 | Yutaka | 123/478 |

FOREIGN PATENT DOCUMENTS

| | | | |
|---|---|---|---|
| 51-83934 | 7/1976 | Japan | 123/478 |
| 53-43616 | 11/1978 | Japan | 123/478 |
| 2005348 | 4/1979 | United Kingdom | 123/478 |

*Primary Examiner*—Ronald B. Cox

*Attorney, Agent, or Firm*—Fleit, Jacobson, Cohn & Price

[57] ABSTRACT

An engine intake system having primary and secondary intake passages leading to the same combustion chamber. The secondary intake passage is provided with an auxiliary throttle valve which is opened under a relatively high load engine operation. The primary and secondary intake passages are respectively provided with first and second fuel injection valves which are controlled by an electronic control unit in accordance with engine operating conditions. The electronic control unit functions to determine a basic fuel supply quantity based on the intake airflow and the engine speed and modify the basic quantity by a compensation factor which is obtained from a compensation map. The compensation map is divided into two zones, the first zone substantially corresponding to the engine operating condition wherein the auxiliary throttle is closed, the second zone substantially corresponding to the engine operating condition wherein the auxiliary throttle valve is opened. The compensation factors in the second zone are determined taking into consideration the difference between the suction pressure at the first fuel injection valve and that at the second fuel injection valve. The second fuel injection valve is operated in the engine operating condition wherein the compensation factor in the second zone is selected.

14 Claims, 12 Drawing Figures

H

| INTAKE PRES. \ ENG. SPEED | | | | | | |
|---|---|---|---|---|---|---|
| 1.15 | 1.14 | 1.20 | 1.25 | 1.30 | 1.30 | 1.35 |
| 1.15 | 1.15 | 1.18 | 1.18 | 1.24 | 1.30 | 1.35 |
| 1.15 | 1.10 | 1.15 | 1.17 | 1.22 | 1.28 | 1.34 |
| 1.15 | 1.00 | 1.00 | 1.11 | 1.16 | 1.22 | 1.27 |
| 1.15 | 1.05 | 1.00 | 1.00 | 1.20 | 1.20 | 1.20 |
| 1.15 | 1.05 | 1.00 | 1.00 | 1.15 | 1.20 | 1.20 |
| 1.15 | 1.10 | 1.10 | 1.10 | 1.15 | 1.20 | 1.20 |

H

| INTAKE PRES. \ ENG. SPEED | | | | | | |
|---|---|---|---|---|---|---|
| 1.15 | 1.15 | 1.20 | 1.25 | 1.30 | 1.30 | 1.35 |
| 1.15 | 1.15 | 1.20 | 1.20 | 1.25 | 1.30 | 1.35 |
| 1.15 | 1.10 | 1.15 | 1.20 | 1.25 | 1.30 | 1.35 |
| 1.15 | 1.00 | 1.00 | 1.15 | 1.20 | 1.25 | 1.30 |
| 1.15 | 1.05 | 1.00 | 1.00 | 1.20 | 1.25 | 1.25 |
| 1.15 | 1.05 | 1.00 | 1.00 | 1.15 | 1.20 | 1.20 |
| 1.15 | 1.10 | 1.10 | 1.10 | 1.15 | 1.20 | 1.20 |

(a)

(b)

FUEL CONTROL MEANS FOR ENGINE INTAKE SYSTEMS

BACKGROUND OF THE INVENTION

1. Field of the Invention

The present invention relates to an intake system for an internal combustion engine and more particularly to an engine intake system having a primary and secondary intake passages. More specifically, the present invention pertains to fuel supply means for an engine intake system having primary and secondary intake passages.

2. Description of Prior Art

In automobile engines, it has been proposed to provide primary and secondary intake passages leading to the same combustion chamber so that the intake air is introduced only through the primary intake passage under certain engine operating conditions but through both the primary and secondary intake passages under other engine operating conditions. For example, in Japanese patent application No. 50-7740 filed on Jan. 20, 1975 and disclosed for public inspection under the disclosure No. 51-83934, there is disclosed an engine having a primary intake passage and a secondary intake passage which are connected to the same combustion chamber. The secondary intake passage is closed under a light load engine operation so that the intake air is passed only through the primary intake passage, but the secondary intake passage is opened under heavy load engine operation so that the intake air is passed through both the primary and secondary intake passages. The primary and secondary intake passages are respectively provided with fuel injection valves and fuel is injected only through the fuel injection valves provided in the primary intake passage under light load engine operation, whereas both the fuel injection valves in the primary and secondary intake passages are used under heavy load operation.

In the engine of the aforementioned type, the control of the secondary intake passage is usually made under the engine intake pressure and the total fuel supply is shared by the fuel valves in the primary and secondary intake passages when the secondary intake passage is opened. In determining the quantity of fuel supply, calculation is at first made in accordance with the engine operating condition to obtain a basic injection period signal which is thereafter modified in several respects to obtain a valve actuating signal. Under light load operation wherein only the primary intake passage is used, the valve actuating signal is applied only to the fuel injection valve in the primary intake passage. However, under heavy load operation, wherein both the primary and secondary intake passages are used for supplying the intake air, the valve actuating signal is shared by the fuel injection valves in both intake passages.

It has been found in this type of intake system that a desired air-fuel ratio cannot be obtained in the transient period wherein the second intake passage is being brought into full operation. In other words, when the fuel supply system is adjusted so that an appropriate amount of fuel is supplied under a first engine operating condition, such as light load operation, the quantity of the fuel supply becomes greater than an optimum value in a transient period wherein the second intake passage in partially opened. On the other hand, if the fuel supply is optimum when the second intake passage is partially open, the fuel supply under the first condition will become smaller than the optimum value. This phenomenon is caused by the fact that the intake suction pressure is stronger in the secondary intake passage than in the primary intake passage, although the difference may be very small, so long as the secondary intake passage is not fully open and the quantity of fuel supply is affected by the suction pressure in the intake passage to which the fuel injection valve is exposed.

In order to solve the problem, there may be provided independent fuel pressure regulators respectively for the fuel injection valves in the primary and secondary intake passages, so that the fuel pressures applied to the respective valves are controlled in response to the intake suction pressures in the corresponding intake passages. It should be noted however that the solution is not advantageous because it requires a plurality of fuel regulators and spaces therefor.

OBJECT OF THE INVENTION

It is therefore an object of the present invention to improve an engine intake system including a primary and secondary intake passages respectively provided with fuel injection valves so that a desired air-fuel ratio can be obtained throughout the engine operating range.

Another object of the present invention is to provide a fuel supply system for an engine intake system having two independent intake passages provided respectively with fuel injection valves, which can provide an accurate amount of fuel supply not only during engine operation wherein only one intake passage is being used but also during engine operation wherein one intake passage is fully opened and the other intake passage is partially opened.

SUMMARY OF THE INVENTION

According to the present invention, the above and other objects can be obtained by an engine intake system including primary intake passage means leading to combustion chamber means, secondary intake passage means leading to said combustion chamber means, first fuel injection valve means provided in said primary intake passage means, second fuel injection valve means provided in said second intake passage means, passage control means having a first position wherein the passage control means substantially closes the secondary intake passage means so that intake air is passed substantially through the primary intake passage means and a second position wherein the secondary intake passage means is at least partially opened so that the intake air is passed through both the primary and secondary intake passage means, fuel supply control means for controlling said first and second fuel injection valve means so that fuel is supplied substantially through said first fuel injection valve means in a first fuel supply mode and through both the first and second fuel injection valve means in a second fuel supply mode, said fuel supply control means including first means for determining a basic quantity of fuel supply in accordance with engine operating conditions, second means including map means having predetermined compensation factors corresponding respectively to different engine operating conditions for modifying the basic quantity respectively under relevant engine operating conditions, said compensation factors in said map means being classified into a first group substantially corresponding to an engine operating condition wherein the passage control means is in said first position, and a second group substantially corresponding to an engine operating condition wherein the passage control means is in the second position, the factors in said first group being determined so that a desired air-fuel ratio can be obtained in said first fuel supply mode, the factors in said second group being determined so that a desired air-fuel ratio can be obtained in said second fuel supply mode, said fuel supply control means including means for taking said first fuel supply mode when the compensating factor of the first group is selected and said second fuel supply mode when the compensating factor of the second group is selected.

Under the second position of the passage control means, the basic quantity multiplied with the compensation factor in the second group is divided into two parts which are respectively under to control the first and second fuel injection valve means. The factors in said map means may be determined in accordance with the engine load and/or the engine speed. The first and second intake passage means may be connected with the combustion chamber means through common intake port means or separate intake port means. The first and second intake passage means may be connected with a common intake passage having a main throttle valve. Then, the passage control means may be an auxiliary throttle valve which starts to open when the main throttle valve is opened to a predetermined value.

According to the features of the present invention, the fuel supply mode is selected in accordance with the group of the compensation factor which is being used but not with the position of the passage control means. Therefore, a desired air-fuel ratio can be obtained both under the first and second position of the passage control means, including a transient period between the first and second positions of the passage control means. Further, a fuel pressure regulator may commonly be used for the first and second fuel injection valve means.

The above and other objects and features of the present invention will become apparent from the following descriptions of preferred embodiments taking reference to the accompanying drawings.

DESCRIPTION OF THE PREFERRED EMBODIMENTS

Figure 2:
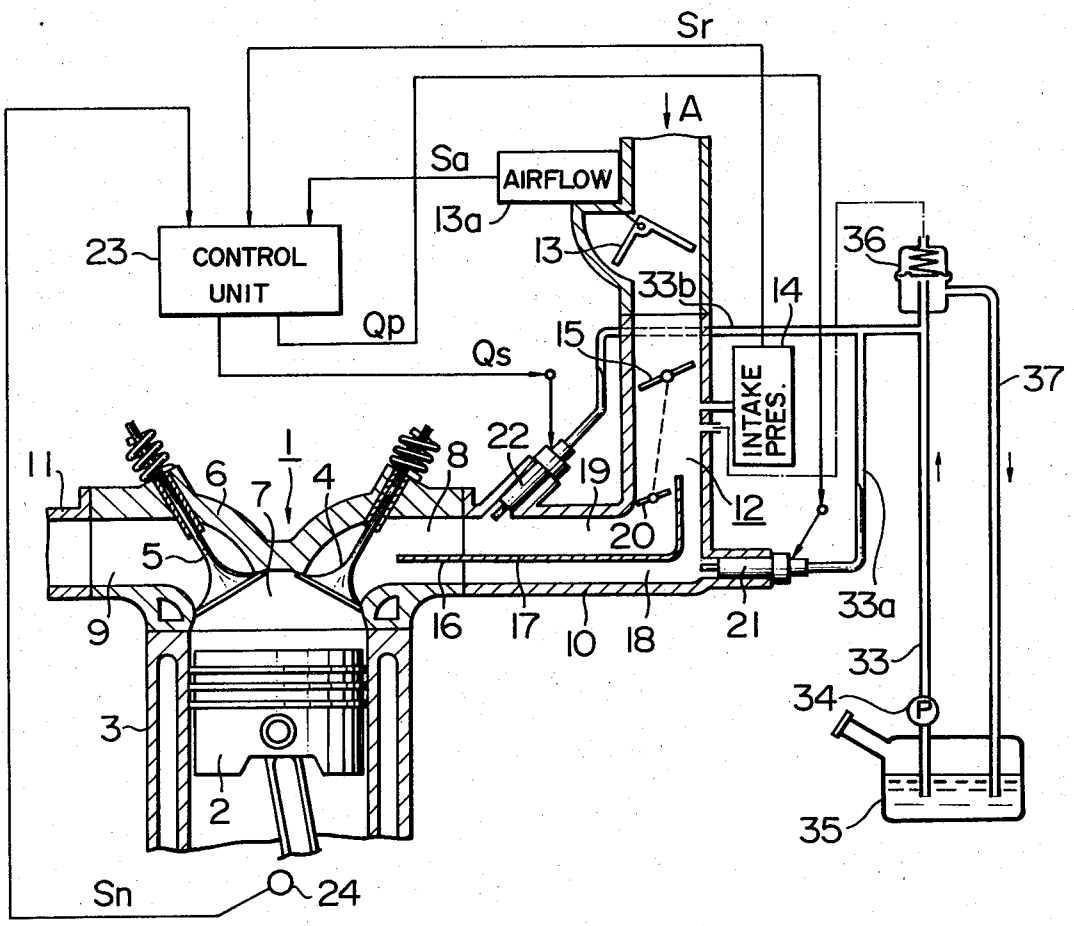
FIG. 2 is a sectional view of an engine having an intake system in accordance with one embodiment of the present invention.

Referring to the drawings, particularly to FIG. 2, there is shown an engine 1 including a cylinder block 3 formed with a cylinder bore 3*a* in which a piston 2 is disposed for reciprocating movements. A cylinder head 6 is mounted on the cylinder block 3 and has a recess for forming a combustion chamber 7. The cylinder head 6 is further formed with an intake port 8 and an exhaust port 9 both opening to the combustion chamber 7. The intake port 8 and the exhaust port 9 are respectively provided with intake and exhaust valves 4 and 5. The intake port 8 is connected with an intake pipe 10 and the exhaust port 9 is connected with an exhaust pipe 11.

The intake pipe 10 defines a main intake passage 12 which is provided at an upstream portion with an airflow sensor 13 having an output 13*a*. Downstream of the airflow sensor 13, there is provided a throttle valve 15 and an intake pressure sensor 14 is provided downstream the throttle valve 15.

Figure 3:
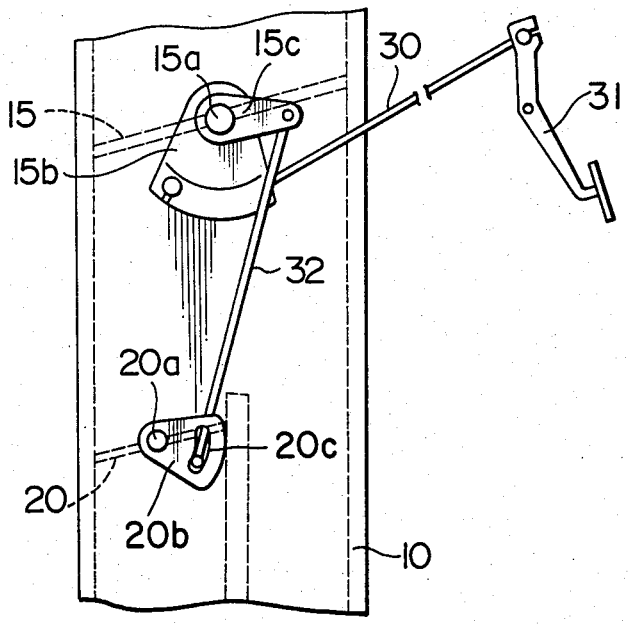
FIG. 3 shows an example of the throttle valve actuating mechanism.

In the intake port 8, there is a partition wall 16. The intake passage 10 is also provided with a partition wall 17 which is contiguous with the partition wall 16. The partition walls 16 and 17 define a primary intake passage 18 and a secondary intake passage 19 which lead from the main intake passage 12. In the secondary intake passage 19, there is provided an auxiliary throttle valve 20. As shown in FIG. 3, the main throttle valve 15 has a shaft 15*a* and an actuating lever 15*b* secured to the shaft 15*a*. The lever 15*b* is connected through a cable 30 with a foot pedal 31 so that the opening of the main throttle valve 15 is controlled by the foot pedal 31. A second lever 15*c* is also secured to the shaft 15*a* of the main throttle valve 15 and an interconnecting link 32 is connected at one end to the lever 15*c*. The auxiliary throttle valve 20 has a shaft 20*a* secured with a lever 20*b*. The lever 20*b* is formed with an arcuate slot 20*c* which receives the other end of the link 32. The connection between the throttle valves 15 and 20 forms a lost-motion mechanism whereby the throttle valve 20 sarts to open when the throttle valve 15 is opened to a predetermined position. For example, the auxiliary throttle valve 20 starts to open when the main throttle valve 15 is opened to one-third of the full open position and thereafter gradually increases its opening as the opening of the main throttle valve 15 increases as shown in FIG. 4.

In the primary intake passage 18, there is a first fuel injection valve 21. Similarly, the secondary intake passage 19 is provided with a second fuel injection valve 22. A fuel supply line 33 having a fuel pump 34 is provided for drawing fuel from a fuel tank 35 and supplying fuel to the fuel injection valves 21 and 22 respectively through branch lines 33*a* and 33*b*. In the fuel supply line 33, there is provided a pressure regulator 36 which senses the intake suction pressure in the main intake passage 12 and returns a part of the fuel in the line 33 through a return line 37 to the tank 35 to thereby maintain substantially constant the difference between the fuel pressure in the line 33 and the pressure in the main intake passage 12.

A fuel supply control unit 23 is provided for controlling the operation of the fuel injection valves 21 and 22. The control unit 23 has inputs connected respectively with the output 13*a* of the airflow sensor 13, the intake pressure sensor 14 and an engine speed sensor 24 for receiving an airflow signal Sa, an intake suction pressure signal Sr and an engine speed signal Sn, respectively. The control unit 23 produces valve actuating pulses Qp and Qs based on the input signals Sa, Sr and Sn and applies these pulses Qp and Qs to the fuel injection valves, respectively.

Figure 1:
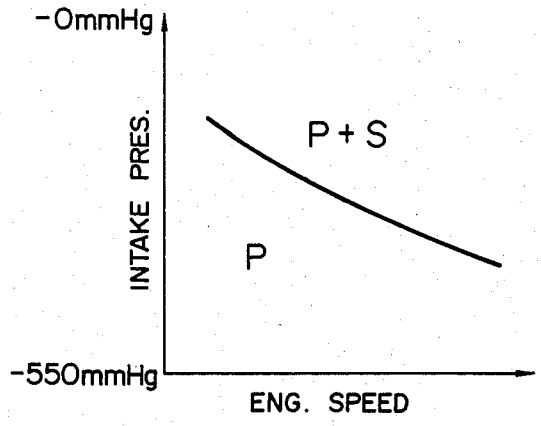
FIG. 1 is a diagram showing the regions wherein the primary and secondary intake passages are opened.
Figure 4:
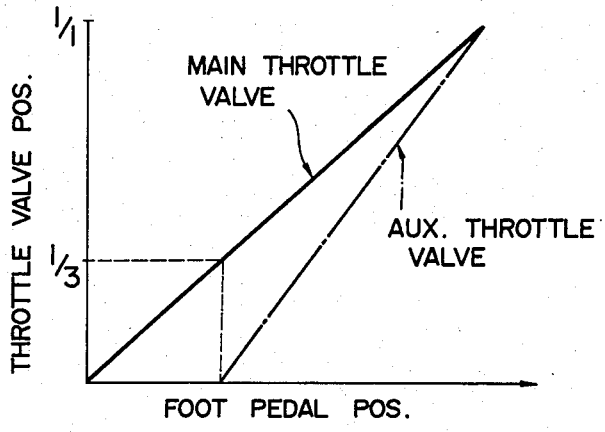
FIG. 4 is a diagram showing the operation of the main and auxiliary throttle valves.

In FIG. 4, it will be noted that the auxiliary throttle valve 20 is closed as long as the opening of the main throttle valve 15 is below a predetermined value, so that the intake air is passed only through the primary intake passage 18 to the combustion chamber 7. This operating region is shown by P in FIG. 1. The control unit 23 then produces only the valve actuating pulse Qp so as to energize the first fuel injection valve 21 only. The duration of the pulse Qp is determined by a basic injection control time as obtained in accordance with the engine speed and the intake airflow and a compensation factor for effecting compensation based on the suction pressure at the first fuel injection valve 21. The compensation factor is obtained from a map as will be described later.

Figure 9:
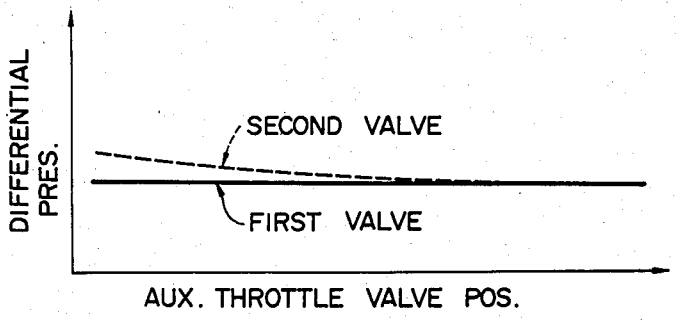
FIG. 9 is a diagram showing the relationship between the opening of the auxiliary throttle valve and the difference between the fuel pressure and the intake pressure.

When the main throttle valve 15 is opened beyond the predetermined position, the auxiliary throttle valve 20 is opened to a position corresponding to the opening of the main throttle valve 15. Thus, the intake air is drawn through both the primary and secondary intake passages 18 and 19 into the combustion chamber 7. This operating region is shown by P+S in FIG. 1. The control unit 23 then produces the valve actuating pulses Qp and Qs so that the fuel is supplied through the first and second fuel injection valves 21 and 22. In this operating condition, the overall duration of the pulses Qp and Qs comprises a basic fuel injection time as obtained based on the airflow and the engine speed and a compensation factor as obtained from the map. The compensation factor is slightly smaller than in a case wherein the fuel is totally supplied through the first fuel injection valve 21 under the same engine operation condition so that the difference in the suction pressure between the passages 18 and 19 can be compensated for. Referring to FIG. 9, it will be noted that the differential pressure at the second fuel injection valve 22 is greater than that at the first fuel injection valve 21. The compensating factors in this operating condition are determined taking the differential pressures into consideration.

Figures 6, 7, 8:
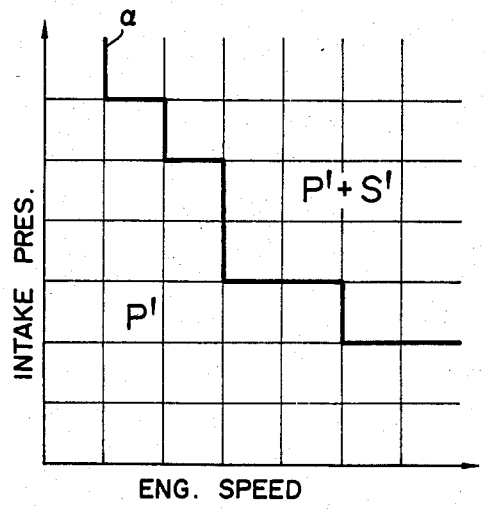
FIG. 6 is an example of the map for the supplementary values in accordance with the present invention.
FIG. 7 shows an exmaple of a conventional map.
FIG. 8 shows the groups in the supplementary value map.

Referring to FIG. 8, it will be noted that the map for the compensation factor is divided into two zones P' and P'+S'. The zone P' is intended to provide the factors under various engine operating conditions wherein the auxiliary throttle valve 20 is closed. The zone P'+S' is intended to provide the factors under various engine operating conditions wherein the auxiliary throttle valve 20 is opened. Comparing the map shown in FIG. 6 with the map shown in FIG. 7, it will be noted that the factors in the zone P'+S' of the map in FIG. 6 are slightly smaller than the corresponding factors in the conventional map of FIG. 7 so that the differential pressures at the first and second fuel injection valves are compensated for. It should be noted that the zones P' and P'+S' in FIG. 8 do not exactly correspond to the zones P and P+S in FIG. 1 because the compensation map is divided into a plurality of square areas. Thus, in square areas on the border line between the zones P and P+S in FIG. 1, the auxiliary throttles valve 20 may be opened in some instances but may not be in other instances. Therefore, if the second fuel injection nozzle 22 is operated in accordance with the operation of the auxiliary throttle valve 20, a satisfactory compensation may not be carried out in the engine operating conditions along the border line between the zones P and P+S in FIG. 1. According to the features of the present invention, the above problems can be solved by making the second fuel injection nozzle to operate when the engine operating condition falls in the zone P'+S' in the compensation map.

Figure 5:
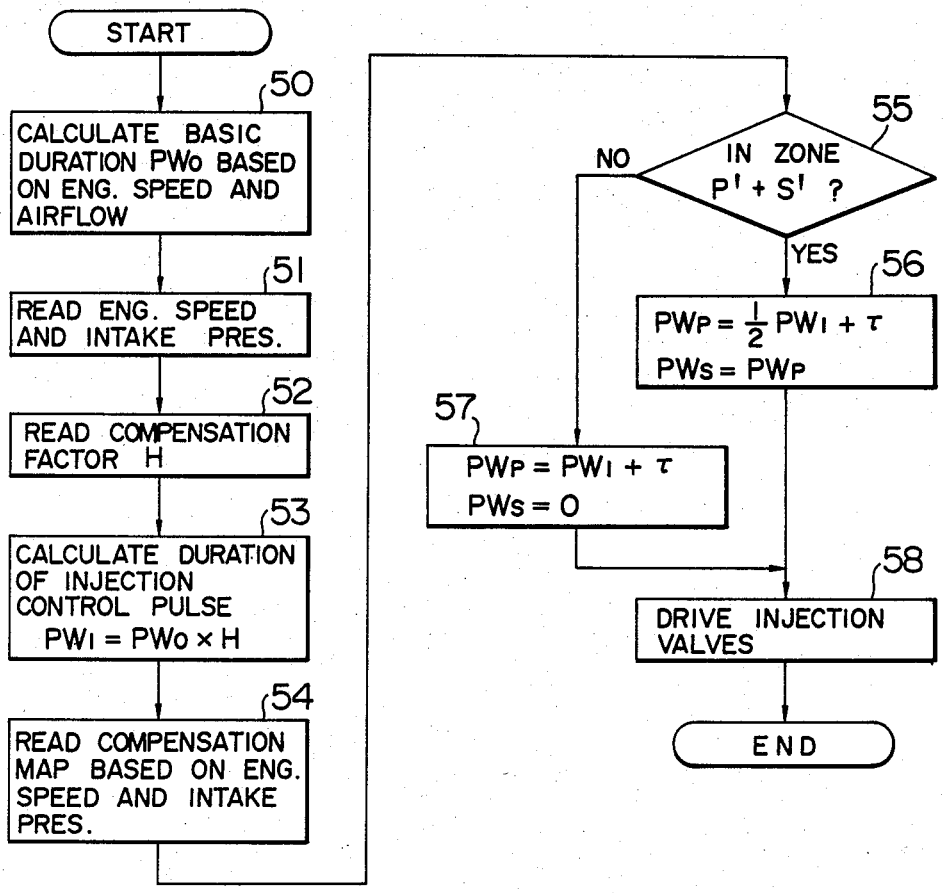
FIG. 5 is a flow chart showing the operation of the control unit.

The control unit 23 may be a microprocessor which may be operated in accordance with the program as shown in FIG. 5. Referring to FIG. 5, the engine speed signal Sn and the airflow signal Sa are at first read in the step 50 to calculate the basic fuel injection pulse duration PWo and thereafter the engine speed signal Sn and the engine intake pressure signal Sr are read in the step 51. Based on the engine speed signal Sn and the engine intake pressure signal Sr, a compensating factor H is read in the step 52 from the map shown in FIG. 6. The compensation factors in the map are determined in accordance with the engine operating conditions as represented by the intake pressure and the engine speed. The step 53 is then carried out to calculate the fuel injection pulse duration $PW_1$ by multiplying the basic duration PWo with the compensation factor H. Thereafter, the compensation factor map is read in the step 54 and a judgement is made in the step 55 as to whether the engine operating condition as represented by the engine speed and the engine intake pressure is in the region P'+S'. If the judgement is YES, the step 56 is carried out to obtain durations PWp and PWs for the pulses Qp and Qs, respectively, by the formula $$PWp = PWs = \tfrac{1}{2} \cdot PW_1 + T$$

where T is an ineffective duration which is required to make the fuel injection valve start to open after application of the valve actuating pulse. When the judgement in the step 55 is NO, calculations are carried out by the formula $$PWp = PW_1 + T$$

$$PWs = o$$

Then the valves 21 and 22 are energized by the pulses Qp and Qs having the durations PWp and PWs, respectively.

Figure 10:
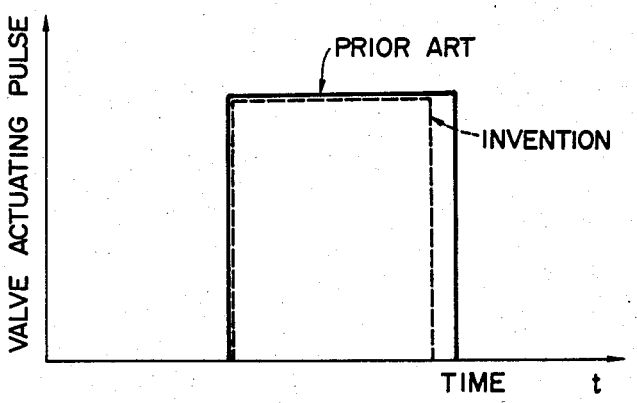
FIGS. 10 (*a*) and (*b*) show the valve actuating pulse and the quantity of fuel supply, respectively; and, FIG. 11 is a diagrammatical illustration of an engine intake system in accordance with another embodiment of the preesent invention.
Figure 10:
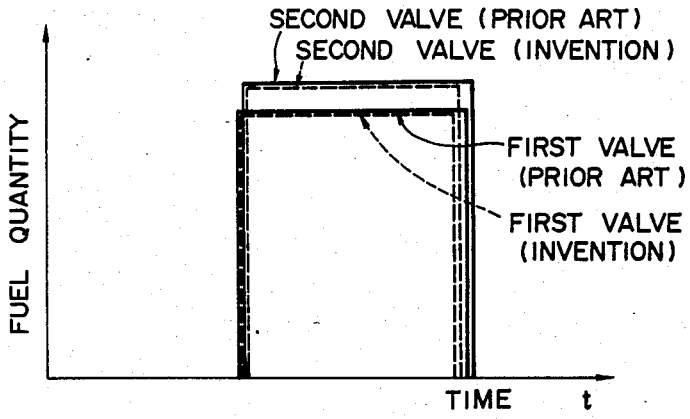

Referring to FIG. 10 (*a*), it will be noted that the durations of the pulses Qp and Qs in the present invention are smaller than those in the conventional system under an engine operating condition wherein the secondary intake passage is partially open. Accordingly, the overall quantity of fuel supply is smaller in the present invention than in the conventional system so that an accurate control of air-fuel ratio can be accomplished by the present invention.

Figure 11:
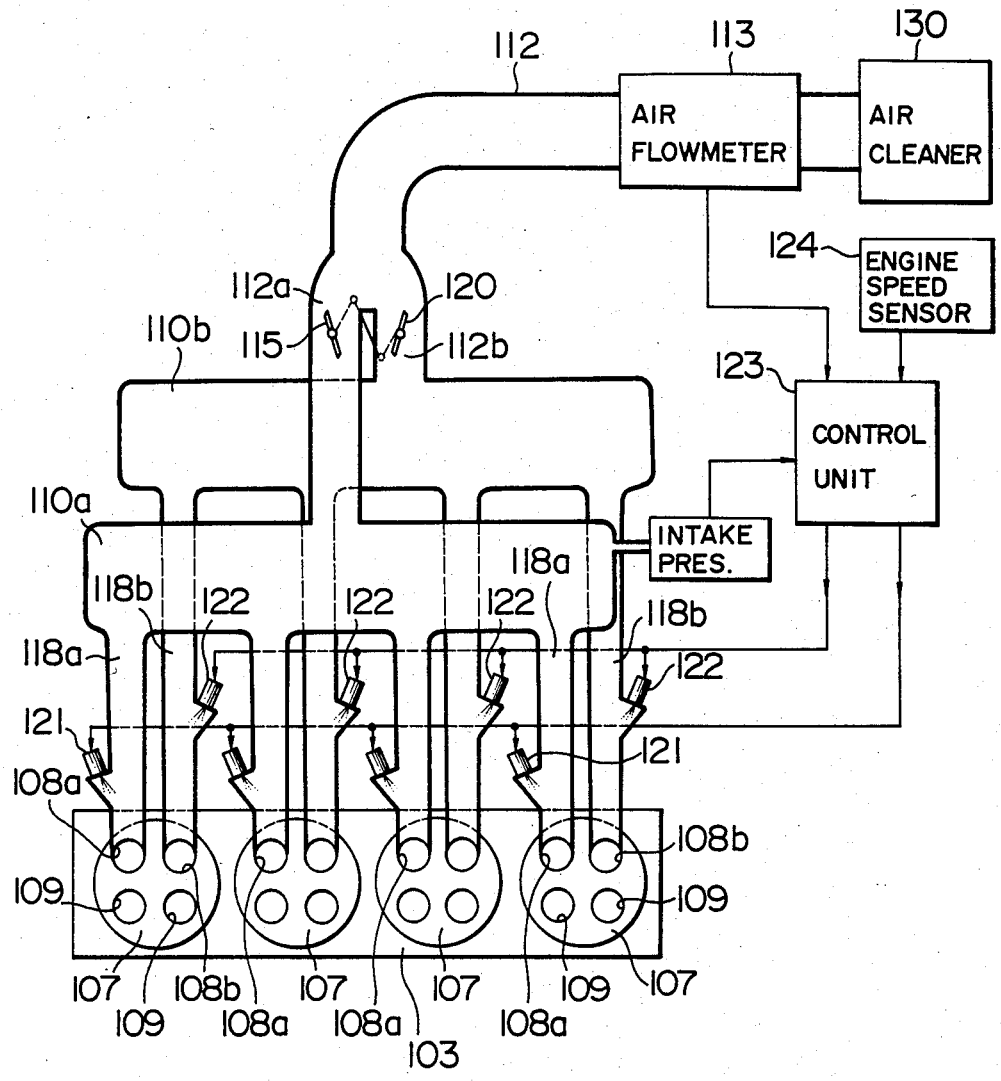

FIG. 11 shows another embodiment of the intake system in which the present invention is applied to a four-cylindered engine. The engine has four combustion chambers 107 formed in a cylinder block 103 and provided with two exhaust ports 109, a primary intake port 108*a* and a secondary intake port 108*b*. There are provided primary intake branch passages 118 which are connected with the primary intake ports 108*a*. The branch passages 118 are branched from an inlet manifold pipe 110*a* which functions as a primary surge tank. There are further provided secondary intake branch passages 118*b* which are connected with the secondary intake ports 108*b*. The secondary intake branch passages 118*b* are branched from an intake manifold pipe 110*b* which functions as a secondary surge tank. The primary intake branch passages 118*a* are connected with a primary intake passage 112*a* having a primary throttle valve 115 through the manifold pipe 110*a*. The secondary intake branch passages 118*b* are connected with a secondary intake passage 112*b* having a secondary throttle valve 120 through the manifold pipe 110*b*. Furthermore, the intake passages 112*a*, 112*b* are connected with a main intake passage 112 provided with an air cleaner 130 and an air flowmeter 113. The secondary throttle valve 120 begins to open when the primary throttle valve 115 is opened to a predetermined position, so as to permit the intake air to pass through the secondary intake passage 112*b*.

The primary intake branch passages 118*a* are respectively provided with primary fuel injection valves 121 and the secondary intake branch passages 118*b* are respectively provided with secondary fuel injection valves 122. The engine is provided with an engine speed sensor 124 which senses the rotating speed of the engine. A control unit 123 is connected with an intake pressure sensor 114, the air flowmeter 113 and the engine speed sensor 124 to receive signals therefrom. The control unit 123 may have the same construction and function as the control unit 23 in the previous embodiment. The control circuit 123 calculates the amount of fuel to be supplied to the engine in accordance with engine operating conditions on the basis of input signals, and operates the primary and secondary fuel injection valves 121 and 122 in accordance with the calculated results.

The invention has thus been shown and described with reference to specific embodiments. However, it should be noted that the invention is in no way limited to the details of the illustrated arrangements, but changes and modifications may be made without departing from the scope of the appended claims.

We claim:

1. An engine intake system including primary intake passage means leading to combustion chamber means, secondary intake passage means leading to said combustion chamber means, said primary and secondary intake passage means being opened to the combustion chamber means through common intake port means, first fuel injection valve means provided in said primary intake passage means, second fuel injection valve means provided in said second intake passage means, passage control means having a first position wherein the passage control means substantially closes the secondary intake passage means so that intake air is passed substantially through the primary intake passage means and a second position wherein the secondary intake passage means is at least partially opened so that the intake air is passed through both the primary and secondary intake passage means, fuel supply control means for controlling said first and second fuel injection valve means so that fuel is supplied substantially through said first fuel injection valve means in a first fuel supply mode and through both the first and second fuel injection valve means in a second fuel supply mode, said fuel supply control means including first means for determining a basic quantity of fuel supply in accordance with engine operating conditions, second means including map means having predetermined compensation factors corresponding respectively to different engine operating conditions for modifying the basic quantity respectively under relevant engine operating conditions, said compensation factors in said map means being classified into a first group substantially corresponding to an engine operating condition wherein the passage control means is in said first position, and a second group substantially corresponding to an engine operating condition wherein the passage control means is in the second position, the factors in said first group being determined so that a desired air-fuel ratio can be obtained in said first fuel supply mode, the factors in said second group being determined so that a desired air-fuel ratio can be obtained in said second fuel supply mode, said fuel supply control means including means for taking said first fuel supply mode when the compensating factor of the first group is selected and said second fuel supply mode when the compensating factor of the second group is selected.

2. An engine intake system including primary intake passage means leading to combustion chamber means, secondary intake passage means leading to said combustion chamber means, first fuel injection valve means provided in said primary intake passage means, second fuel injection valve means provided in said second intake passage means, passage control means having a first position wherein the passage control means substantially closes the secondary intake passage means so that intake air is passed substantially through the primary intake passage means and a second position wherein the secondary intake passage means is at least partially opened so that the intake air is passed through both the primary and secondary intake passage means, fuel supply means for supplying fuel under pressure which is controlled in accordance with an intake pressure, fuel supply control means for controlling said first and second fuel injection valve means so that fuel is supplied substantially through said first fuel injection valve means in a first fuel supply mode and through both the first and second fuel injection valve means in a second fuel supply mode, said fuel supply control means including first means for determining a basic quantity of fuel supply in accordance with engine operating conditions, second means including map means having predetermined compensation factors corresponding respectively to different engine operating conditions for modifying the basic quantity respectively under relevant engine operating conditions so that at least any difference between the intake pressure for controlling the pressure of the fuel and the intake pressure at each fuel injection valve means can be compensated for, said compensation factors in said map means being classified into a first group substantially corresponding to an engine operating condition wherein the passage control means is in said first position and a second group substantially corresponding to an engine operating condition wherein the passage control means is in the second position, the factors in said first group being determined so that a desired air-fuel ratio can be obtained in said first fuel supply mode, the factors in said second group being determined taking into account a difference between the intake pressure at the first fuel injection valve means and the intake pressure at the second fuel injection valve means so that a desired air-fuel ratio can be obtained in the second fuel supply mode, said fuel supply control means including means for taking said first fuel supply mode when the compensating factor of the first group is selected and said second fuel supply mode when the compensation factor of the second group is selected.

3. An engine intake system including primary intake passage means leading to combustion chamber means. secondary intake passage means leading to said combustion chamber means, first fuel injection valve means provided in said primary intake passage means, second fuel injection valve means provided in said second intake passage means, passage control means including control valve means which has a first position wherein the control valve means substantially closes the secondary intake passage means and permits the primary intake passage means to remain at least partially open so that intake air is passed substantially through the primary intake passage means, and a second position wherein the secondary intake passage means and the primary intake passage means are each at least partially opened so that the intake air is passed through both the primary and secondary intake passage means, valve control means for moving the control valve means from the first position to the second position when intake air flow is increased beyond a predetermined value, said second fuel injection valve means being located downstream of the control valve means, fuel supply means including fuel pump means and fuel pressure regulating means for supplying fuel under pressure, fuel supply control means for controlling said first and second fuel injection valve means so that fuel is supplied substantially through said first fuel injection valve means in a first fuel supply mode and through both the first and second fuel injection valve means in a second fuel supply mode, said fuel supply control means including map means having predetermined factors for determining a quantity of fuel supply in accordance with engine operating conditions so that a desired air-fuel ratio can be obtained throughout a range of engine operating conditions.

4. An engine intake system in accordance with claim 2 in which said map means has the compensation factors determined in accordance with loads on the engine.

5. An engine intake system in accordance with claim 4 in which said compensation factors are determined further in accordance with engine speed.

6. An engine intake system in accordance with claim 5 in which said primary and secondary intake passage means are opened to the combustion chamber means through common intake port means.

7. An engine intake system in accordance with claim 5 in which said primary and secondary intake passage means are opened to the combustion chamber means through separate intake port means.

8. An engine intake system in accordance with claim 2 in which said map means has the compensation factors determined in accordance with engine speed.

9. An engine intake system in accordance with claim 2 in which said first means in the fuel supply control means is means for determining the basic quantity of fuel supply in accordance with an intake airflow and an engine speed.

10. An engine intake system in accordance with claim 2 in which said primary and secondary intake passage means are opened to the combustion chamber means through separate intake port means.

11. An engine intake system in accordance with claim 2 in which said primary and secondary intake passage means are connected with common intake passage means provided with a main throttle valve, said passage control means being an auxiliary throttle valve located in the secondary intake passage means.

12. An engine intake system in accordance with claim 2 which includes a main throttle valve provided in said primary intake passage means, manual means for controlling position of the main throttle valve means, said passage control means being an auxiliary throttle valve located in the secondary intake passage means and interconnected with the main throttle valve so that the auxiliary throttle valve starts to open when the main throttle valve is opened to a predetermined position.

13. An engine intake system in accordance with claim 3 in which said fuel pressure regulating means includes means for regulating fuel pressure in accordance with an engine intake pressure.

14. An engine intake system in accordance with claim 3 in which said factors in said map means are determined in accordance with engine speed and engine intake pressure.

* * * * *